US007390207B2

(12) United States Patent
Noguchi et al.

(10) Patent No.: US 7,390,207 B2
(45) Date of Patent: Jun. 24, 2008

(54) SELF-ALIGNING CONNECTOR

(75) Inventors: Takamitsu Noguchi, Sakura (JP); Shigeru Ishikawa, Sagamihara (JP); Kotaro Hayashi, Sagamihara (JP)

(73) Assignee: Fujikura Ltd., Tokyo (JP)

( * ) Notice: Subject to any disclaimer, the term of this patent is extended or adjusted under 35 U.S.C. 154(b) by 153 days.

(21) Appl. No.: 11/363,936

(22) Filed: Mar. 1, 2006

(65) Prior Publication Data

US 2006/0199415 A1 Sep. 7, 2006

(30) Foreign Application Priority Data

Mar. 7, 2005 (JP) ..... P2005-063006

(51) Int. Cl.
*H01R 13/64* (2006.01)

(52) U.S. Cl. ..... 439/248

(58) Field of Classification Search ..... 439/350, 439/247–248, 571, 34, 573, 329; 296/152, 296/146

See application file for complete search history.

(56) References Cited

U.S. PATENT DOCUMENTS

| | | | | |
|---|---|---|---|---|
| 5,893,768 | A | 4/1999 | Gawron et al. | |
| 6,159,030 | A | 12/2000 | Gawron et al. | |
| 6,325,652 | B1 * | 12/2001 | Grant | 439/248 |
| 7,059,882 | B2 * | 6/2006 | Sugita et al. | 439/247 |

FOREIGN PATENT DOCUMENTS

| | | | |
|---|---|---|---|
| EP | 1 096 617 | A1 | 5/2001 |
| JP | 11-191456 | A | 7/1999 |
| JP | 11-354208 | A | 12/1999 |
| JP | 11-354209 | A | 12/1999 |
| JP | 2000-123916 | A | 4/2000 |
| JP | 2000-123917 | A | 4/2000 |
| JP | 2000-150075 | A | 5/2000 |
| JP | 2000-215944 | A | 8/2000 |
| JP | 2003-217751 | A | 7/2003 |
| JP | 2005-93270 | A | 4/2005 |
| JP | 2005-166348 | A | 6/2005 |
| JP | 2005-166349 | A | 6/2005 |
| JP | 2005-174823 | A | 6/2005 |
| JP | 2005-183033 | A | 7/2005 |
| JP | 2005-190720 | A | 7/2005 |

* cited by examiner

*Primary Examiner*—Jean F Duverne
(74) *Attorney, Agent, or Firm*—Sughrue Mion, PLLC

(57) ABSTRACT

A self-aligning connector, comprising: a female connector which is adapted to include at least one electrical component and to be optionally secured to one securing portion; a male connector connectable to the female connector, the male connector being adapted to include at least one electrical component and to be optionally secured to another securing portion; and at least one connector cover and at least one slide plate, which are disposed between the one securing portion and the another securing portion; wherein the at least one connector cover includes a plurality of resilient pawls, which has distal ends located in the vicinity of a connector cover center portion in front-rear and left-right directions in the plane of the at least one connector cover; wherein the at least one slide plate includes a receiving portion in which resilient pawls are inserted and engaged; and wherein the resilient pawls absorb deviations in the front-rear and left-right directions occurring at the time of connecting the female and the male connectors to properly align the female and the male connectors.

15 Claims, 5 Drawing Sheets

FIG. 2
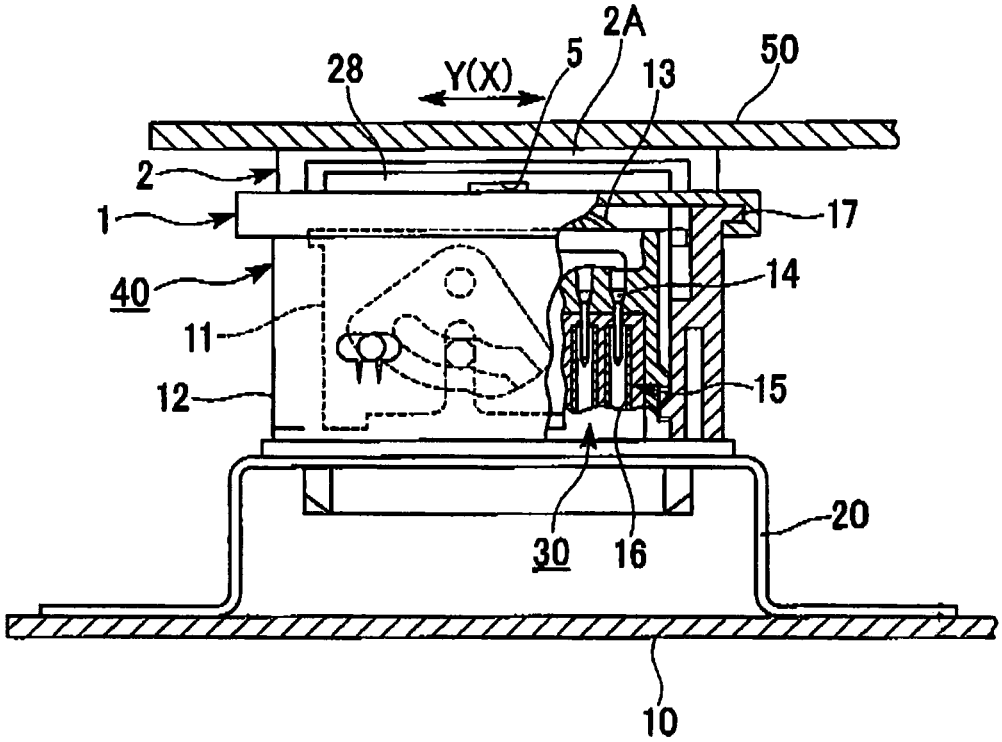
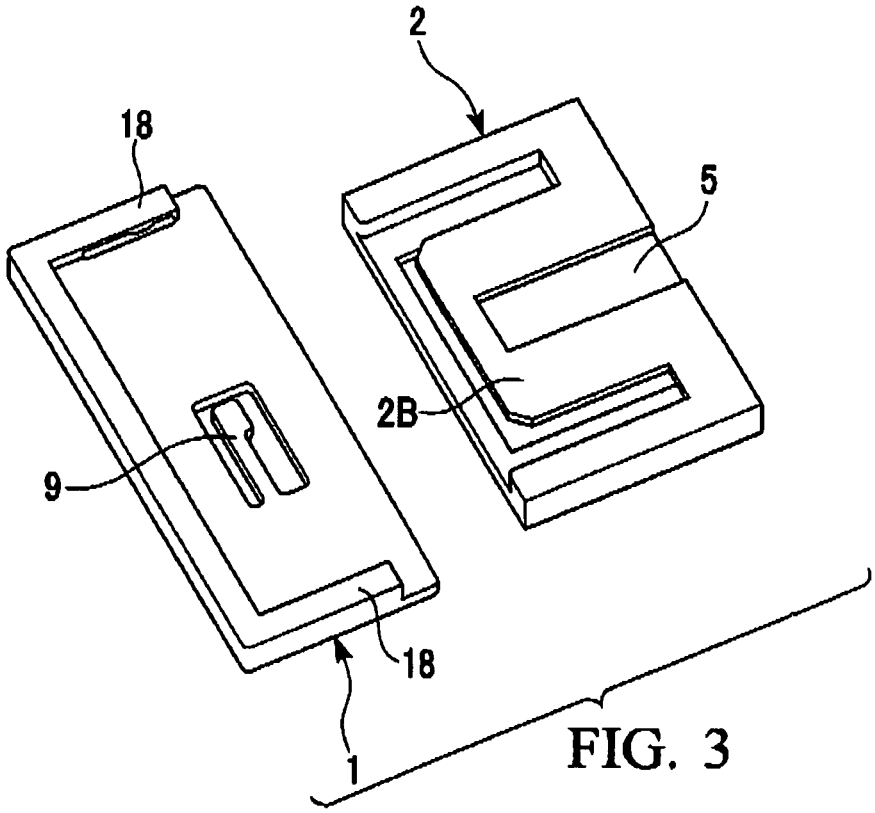
FIG. 3

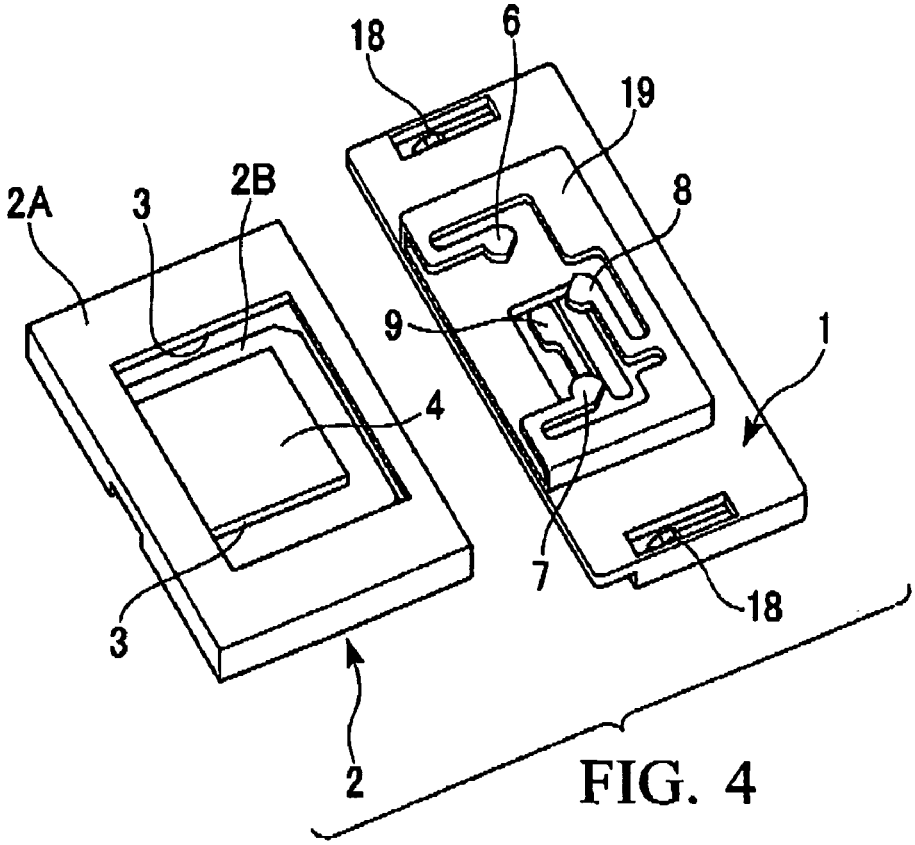
FIG. 4
FIG. 5
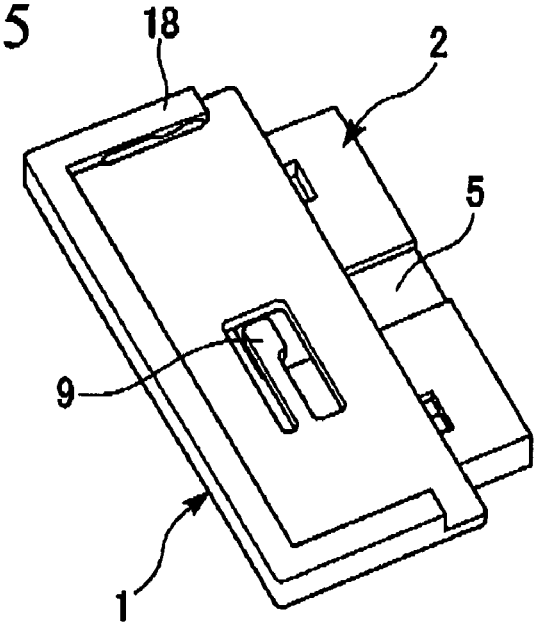

SELF-ALIGNING CONNECTOR

BACKGROUND OF THE INVENTION

1. Field of the Invention

The present invention relates to a self-aligning connector which cal be used when parts of a modular structure of a vehicle or the like are assembled and which has a function of self-aligning, Priority is claimed on Japanese Patent Application No. 2005-63006, filed Mar. 7, 2005, the content of which is incorporated herein by reference.

2. Description of the Related Art

An example of a conventional connector with a self-aligning function is shown in FIG. 7, which is used when a female connector 100 and a male connector 101 are fitted to each other. A vehicle, e.g., an automotive vehicle, is provided with an instrument panel which has a partition wall with an opening into which the female connector 100 is fitted. The female connector has four spring pieces 102 formed therein. A guide projecting portion 103 which is latched by these spring pieces 102 of the female connector 100 is inserted in a guide groove 104 of the male connector 101. An antenna plug for audio 105, for example, is inserted in the guide projecting portion 103. The plug 105 is inserted in an antenna jack within the guide groove 104. At this time, even if centers of the plug 105 and the antenna jack are off-set from one another, misalignment can be corrected due to elastic deformation of the spring pieces 102, namely, a self-aligning can be implemented (see, e.g., Japanese Patent Application, First Publication No. 2000-215944 (Page 6; FIG. 3).

In the conventional self-aligning connector, it is necessary to provide such spring pieces at four portions as a centering means such that deviation occurring at the time of connecting with respect to its counterpart can be absorbed by those spring pieces being deformed. However, such a structure or spring pieces can absorb a relatively small deviation only. In other words, in order to absorb a considerable or large deviation, it is necessary to set the amounts of deformations of such spring pieces to be larger. In that case, the need to make the dimensions of a securing portion (or of the opening of the partition wall), to which the female connector is secured, larger is inevitable. As a result, it is difficult or impossible to mount or provide such a connecting structure where there is not sufficient space.

SUMMARY OF THE INVENTION

The present invention has been made in light of the above-described circumstances. An object of the present invention is to provide a self-aligning connector (structure), wherein a relatively large deviation during assembly can be absorbed, wherein a centering function thereof is inherently superior to that obtainable using most conventional ones, and wherein it is downsizable.

In order to achieve the above object, according to a first aspect of the present invention, a self-aligning connector is provided, comprising: a female connector which is adapted to include at least one electrical component and to be optionally secured to one securing portion; a male connector connectable to the female connector, the male connector being adapted to include at least one electrical component and to be optionally secured to another securing portion; and at least one connector cover and at least one slide plate, which are disposed between the one securing portion and the another securing portion; wherein the connector cover includes a plurality of resilient pawls, distal ends of which are located in the vicinity of a connector cover center portion in front-rear and left-right directions in the plane of the connector cover, wherein the slide plate includes a receiving portion in which resilient pawls are inserted and engaged; and wherein the resilient pawls absorb deviations in the front-rear and left-right directions occurring at the time of connecting the female and the male connectors to properly align the female and the male connectors.

According to a second aspect of the present invention, in the self-aligning connector of the first aspect of the present invention, the connector cover and the slide plate are provided at at least one of between the one securing portion and the female connector and between the another securing portion and the male connector.

According to a third aspect of the present invention, in the self-aligning connector of the first aspect of the present invention, the connector cover and the slide plate are provided between the another securing portion and the male connector.

According to a fourth aspect of the present invention, in the self-aligning connector of the third aspect of the present invention, the connector cover is secured to the male connector, and the slide plate is secured to the another securing portion.

According to a fifth aspect of the present invention, in the self-aligning connector of the first aspect of the present invention, the receiving portion includes an opening and a slot.

According to a sixth aspect of the present invention, in the self-aligning connector of the fifth aspect of the present invention, the connector cover includes a frame body located at a substantial center of the connector cover, and the frame body is formed with three resilient pawls which are inserted and engaged in the opening of the slide plate.

According to a seventh aspect of the present invention, in the self-aligning connector of the sixth aspect of the present invention, amounts of elastic deformations of the three resilient pawls are settable by way of a clearance between the frame and each of to three resilient pawls.

Those and other objects, characteristics and advantages of the present invention will be apparent to those skilled in the art from the description of the exemplary embodiment of the invention as depicted in the attached drawings and from the attached claims.

BRIEF DESCRIPTION OF THE DRAWINGS

FIG. 2 is a partial cross-sectional view illustrating an assembled state of the embodiment.

FIG. 3 is a peeve view illustrating a connector cover and a slide plate before assembly, when view from a back side.

FIG. 4 is a similar view to FIG. 3, but when viewed from a front side.

FIG. 5 is a perspective view illustrating the connector cover and the slide plate after assembly, when viewed from the back side.

DETAILED DESCRIPTION OF THE INVENTION

Hereinafter, embodiments of the present invention will be described in detail with reference to the drawings.

Figure 1:
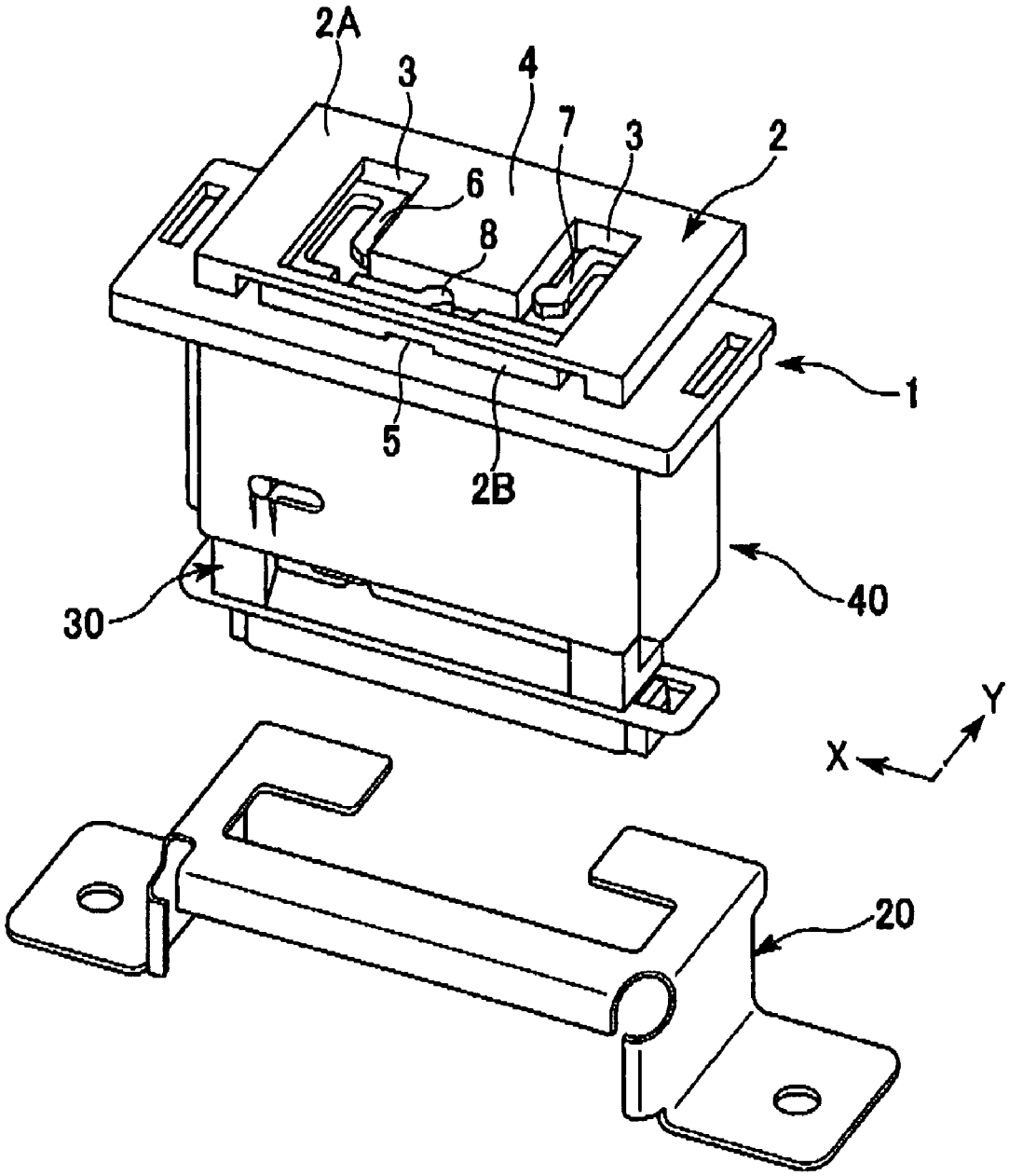
FIG. 1 is an exploded perspective general view illustrating an embodiment of a self-aligning connector according to the present invention.

FIG. 1 illustrates an embodiment of a self-aligning connector assembly or parts of a modular struggle of a vehicle, such as an automotive vehicle, but not limited thereto, according to the present invention. A bracket 20 (one securing portion) is fixed to, for example, a vehicle body 10 of the automotive vehicle. A female connector 30 is secured to the securing bracket 20. A male connector 40 fits in the female connector 30. A connector cover 1 covers the male connector 40. A slide plate 2 is secured to the connector cover 1.

The slide plate 2 is fixed to, for example, a center console panel 50 (another securing portion) of the automotive vehicle (see FIG. 2). The slide plate 2 has an upper plate 2A in which a U-shaped opening 3 is formed such that a centrally-located extended piece 4 is provided. A lower plate 2B is secured to the upper plate 2A, maintaining a clearance therefrom. The lower plate 2B is formed with a (open-sided) slot 5.

The connector cover 1 is provided with four resilient pawls 6 trough 9 (the resilient pawl 9 is not illustrated in FIG. 1). Of these four resilient pawls, the resilient pawls 6, 7, and 8 are positioned within the U-shaped opening 3, distal ends of which abut respectively three side surfaces of the centrally-located extended piece 4 of the slide plate 2.

As illustrated in FIG. 1, in the plane of the connector cover 1, a font-rear direction is indicated by arrow X, and a left-right direction is indicated by arrow Y. Two of the resilient pawls 6 and 7 are separated from each other and disposed along the X direction, whereas the other two resilient pawls 8 and 9 are separated from each other and disposed along the Y direction. The distal ends of the resilient pawls 6, 7, and 8 are located in the vicinity of a center portion of the connector cover 1

FIG. 2 illustrates a partial sectional view of the self-aligning connector assembly after assembly. A main body portion 11 of the male connector 40 is received in a holder 12 of the female connector 40. In this exemplary embodiment, a plurality of wires 13 are exposed from a terminal end of an unillustrated wiring harness and connected to connecting terminals 14 of a plug type and to connecting terminals 15 of a receptacle type.

The receptacle type connecting terminals 15 are housed in terminal receiving chambers 16 of the female connector 30. Flanges 17 of the holder 12 of the female connector 40 are inserted into latching portions 18 of the connector cover 1, so that the connector cover 1 is secured to the male connector 40.

FIGS. 3 and 4 are perspective views illustrating the connector cover 1 and the slide plate 2 before assembly, when viewed from a back side and a front side thereof, respectively. The connector cover 1 is of a rectangular shape and has the latching portions 18 at the short sides of the rectangular connector cover 1.

As described above, the flanges 17 of the (foregoing) holder 12 are inserted into and hooked over the latching portions 18. The resilient pawl 9 is formed by cutting such that the distal end thereof is positioned in the vicinity of the center of the connector cover 1. A bulbous portion of the distal end of the resilient pawl 9 is fined in the slot 5 formed in the lower plate 2B of the slide plate 2.

The three resilient pawls 6, 7, and 8 are formed such that proximal ends of those pawls 6 to 8 are connected to an inner side of a frame body 19, the frame body 19 being formed so as to stand upright from a center portion of an upper surface of the connector cover 1. Each of the resilient pawls 6, 7, and 8 is extended parallel to the frame body 19 from a junction with respect to the frame body 19, and has the bulbous portion at the distal end thereof.

If an extended length of each of the resilient pawls 6, 7, and 8 is made longer or if a distance between each of the resilient pawls 6, 7, and 8 and the inner side of the frame body 19 is made longer, an amount of deflection of each pawl (6-8) can be longer. Therefore, a relatively large dimensional deviation can be absorbed. Further, since every one of the resilient pawls 6 to 9 is extended, not toward an outer side of the connector cover 1, but toward an inner side or a substantial center of the connector cover 1, it is unnecessary to make the slide plate 2 larger. Thus, widening an attaching surface of the slide plate 2 is unnecessary.

As described above, the U-shaped opening 3 is formed at an upper surface side of the slide plate 2, so that the extended piece 4 is centrally-located and formed. The (aforesaid) resilient pawls 6, 7, and 8 are set within the opening 3 such that the distal ends thereof touch the three side surfaces of the extended piece 4.

Figure 6:
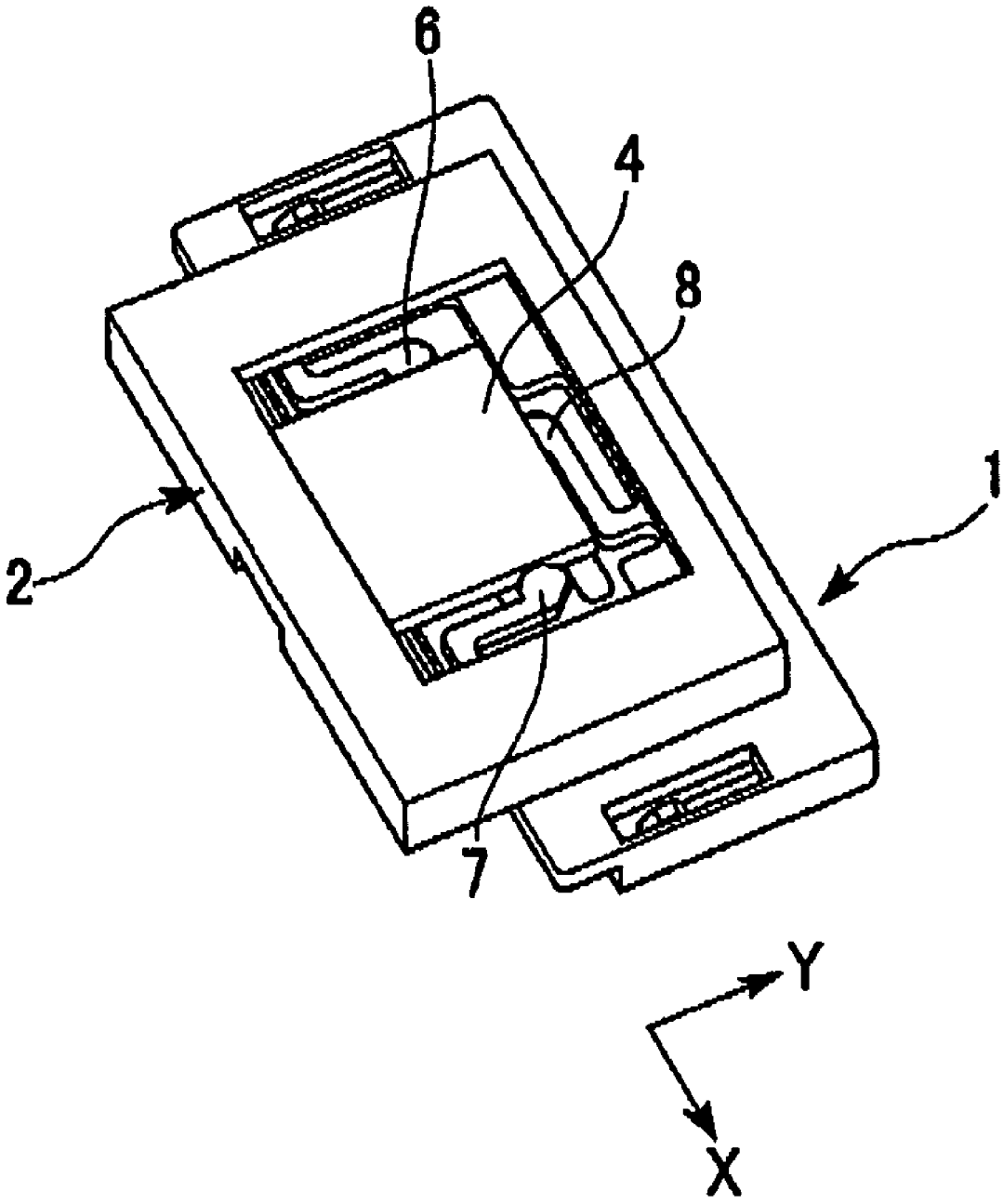
FIG. 6 is a similar view to FIG. 5, but when viewed film the front side.
Figure 7:
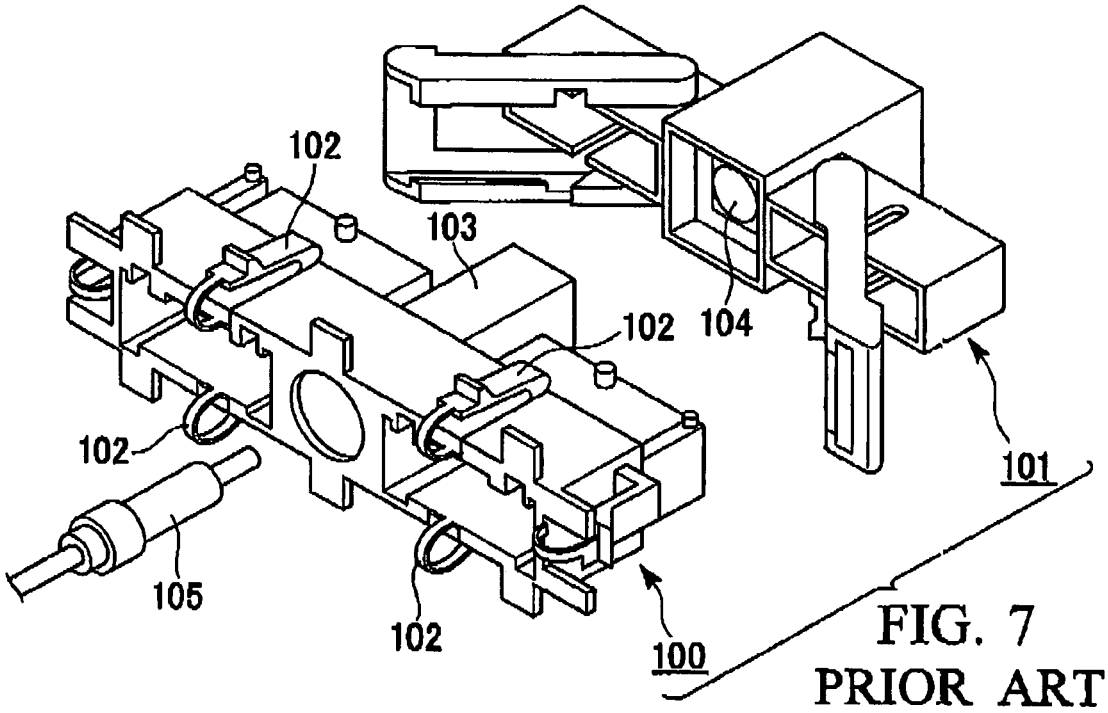
FIG. 7 PRIOR ART
FIG. 7 is a perspective view illustrating an example of a conventional connector structure.

FIGS. 5 and 6 are back side and front side perspective views, respectively; illustrating the connector cover 1 and the slide plate 2 after assembly. As is shown in FIG. 6, since the connector cover 1 is moveable in the X and Y directions (the front-rear direction and the left-right direction) with respect to the other securing portion (or the panel 50), aligning or centering the terminals 14 and 15 is possible. At this time, movement in the X and Y directions is attainable because of deflection of the resilient pawls 6 to 9. It is important for the four resilient pawls 6 to 9 to be provided such that, in the plane of the connector cover 1, the distal ends of the resilient pawls 6 to 9 are located in the vicinity of the center of the connector cover 1 in the front-rear and left-right directions (or in the X and Y directions, respectively). Since the resilient pawls 6 to 9 are structured to be deformable within the predetermined central area of the connector, such means for aligning or centering can be downsized, and therefore, compactness in overall design can be realized.

Although the present invention has been described with reference to the specific embodiment, this description is not meant to be construed in a limiting sense. Various modifications of the disclosed embodiment, as well as alternative embodiments of the invention, will be apparent to persons skilled in the art upon reference to the description of the invention. It is therefore contemplated that such modifications can be made without departing from the sprit or scope of the present invention as defined in the appended claims.

For example, although the embodiment described above is structured such that the connector cover 1 and the slide plate 2 are provided between the other securing portion (center console panel 50) and the male connector 40, another exemplary structure is possible in which the connector cover 1 and the slide plate 2 are provided between the one securing bracket/portion 20 and the female connector 30. Another exemplary structure is also possible in which the connector cover 1 and the slide plate 2 are provided both of between the one securing bracket/portion 20 and the female connector 30 and between the another securing portion (center console panel 50) and the male connector 40.

Further, the above-described embodiment is structured such that the connector cover 1 is secured to the male connector 40, and the slide plate 2 is secured to the another securing portion (center console panel 50). However, the present invention is not limited to the same. A reverse structure is possible. Namely, the connector cover 1 may be secured to the another securing portion (center console panel 50) and the slide plate 2 may be secured to the male connector 40.

Note that amounts of elastic deformations of the four exemplary resilient pawls 6, 7, 8, and 9 are settable by way of the clearance bet the frame body 19 and each of the four resilient pawls 6, 7, 8, and 9.

What is claimed is:

1. A self-aligning connector comprising:

a female connector which is adapted to include a plurality of electrical components which is secured to one securing portion;

a male connector connectable to the female connector, the male connector being adapted to include a plurality of electrical components which is secured to another securing portion; and a connector cover and a slide plate, which are disposed between the one securing portion and the another securing portion;

wherein the connector cover includes a plurality of resilient pawls, which has distal ends located in the vicinity of a center portion of the connector cover in front-rear and left-right directions in the plane of the connector cover;

wherein the slide plate includes a receiving portion in which the resilient pawls are inserted and engaged;

wherein the resilient pawls absorb deviations in the front-rear and left-right directions occurring at the time of connecting the female and the male connectors;

wherein the receiving portion includes an opening and a slot; and wherein the connector cover includes a frame body located at a substantial center of the connector cover, and the frame body is formed with three resilient pawls, which are inserted and engaged in the opening of the slide plate.

2. The self-aligning connector according to claim 1, wherein the connector cover and the slide plate are disposed at at least one position between the one securing portion and the female connector and between the another securing portion and the male connector.

3. The self-aligning connector according to claim 2, wherein the connector cover and the slide plate are provided between the another securing portion and the male connector.

4. The self-aligning connector according to claim 2, wherein the connector cover is secured to the male connector, and the slide plate is secured to the another securing portion.

5. The self-aligning connector according to claim 1, wherein amounts of elastic deformations of the three resilient pawls are settable by way of the clearance between the frame body and each of the three resilient pawls.

6. The self-aligning connector according to claim 4, wherein the connector cover and the slide plate are disposed at one position between the one securing portion and the female connector and where another connector cover and another slide plate are disposed at a second position between the another securing portion and the male connector.

7. A self-aligning connector comprising:

a female connector which is adapted to include a plurality of electrical components which is secured to one securing portion;

a male connector connectable to the female connector, the male connector being adapted to include a plurality of electrical components which is secured to another securing portion; and a connector cover and a slide plate, which are disposed between the one securing portion and the another securing portion;

wherein the connector cover includes a plurality of resilient pawis, which has distal ends located in the vicinity of a center portion of the connector cover in front-rear and left-right directions in the plane of the connector cover;

wherein the slide plate includes a receiving portion in which the resilient pawls are inserted and engaged;

wherein the resilient pawls absorb deviations in the front-rear and left-right directions occurring at the time of connecting the female and the male connectors; and wherein the plurality of resilient pawls include three pawls on one side of the connector plate and one pawl on the other side of the connector plate.

8. A self-aligning connector comprising:

a female connector which is adapted to include a plurality of electrical components which is secured to one securing portion;

a male connector connectable to the female connector, the male connector being adapted to include a plurality of electrical components which is secured to another securing portion; and a connector cover and a slide plate, which are disposed between the one securing portion and the another securing portion;

wherein the connector cover includes a plurality of resilient pawls, which has distal ends located in the vicinity of a center portion of the connector cover in front-rear and left-right directions in the plane of the connector cover;

wherein the slide plate includes a receiving portion in which the resilient pawls are inserted and engaged;

wherein the resilient pawls absorb deviations in the front-rear and left-right directions occurring at the time of connecting the female and the male connectors; and wherein the plurality of resilient pawls include three pawls positioned within a U-shaped opening of the connector cover, and where distal ends of the three pawls abut respectively three side surfaces of a centrally-located extended piece of the slide plate.

9. The self-aligning connector according to claim 8, wherein two of the three pawls positioned within the U-shaped opening of the connector cover are separated from each other and disposed along the front-rear direction in the plane of the connector cover, whereas the third pawl is disposed along a left-right direction in the plane of the connector cover.

10. A self-aligning connector comprising:

a female connector which is adapted to include a plurality of electrical components which is secured to one securing portion;

a male connector connectable to the female connector, the male connector being adapted to include a plurality of electrical components which is secured to another securing portion; and a connector cover and a slide plate, which are disposed between the one securing portion and the another securing portion;

wherein the connector cover includes a plurality of resilient pawls, which has distal ends located in the vicinity of a center portion of the connector cover in front-rear and left-right directions in the plane of the connector cover;

wherein the slide plate includes a receiving portion in which the resilient pawls are inserted and engaged;

wherein the resilient pawls absorb deviations in the front-rear and left-right directions occurring at the time of connecting the female and the male connectors; and wherein the female connector has at least one flange which is inserted into and hooked over at least one latching portion of the connector cover to secure the connector cover to the male connector, where the at least one latching portion is disposed at at least one short side of the connector cover, which is a rectangular shape.

11. A self-aligning connector comprising:

a female connector which is adapted to include a plurality of electrical components which is secured to one securing portion;

a male connector connectable to the female connector, the male connector being adapted to include a plurality of electrical components which is secured to another securing portion; and a connector cover and a slide plate, which are disposed between the one securing portion and the another securing portion;

wherein the connector cover includes a plurality of resilient pawls, which has distal ends located in the vicinity of a center portion of the connector cover in front-rear and left-right directions in the plane of the connector cover;

wherein the slide plate includes a receiving portion in which the resilient pawls are inserted and engaged;

wherein the resilient pawls absorb deviations in the front-rear and left-right directions occurring at the time of connecting the female and the male connectors; and wherein the slide plate having the plurality of resilient pawls include one pawl having a bulbous portion of a distal end where the one pawl is positioned in the vicinity of the center of the connector cover, such that the bulbous portion of the distal end of the one pawl is fitted in a slot formed in a lower plate of the slide plate.

12. A self-aligning connector comprising:

a female connector which is adapted to include a plurality of electrical components which is secured to one securing portion;

a male connector connectable to the female connector, the male connector being adapted to include a plurality of electrical components which is secured to another securing portion; and a connector cover and a slide plate, which are disposed between the one securing portion and the another securing portion;

wherein the connector cover includes a plurality of resilient pawls, which has distal ends located in the vicinity of a center portion of the connector cover in front-rear and left-right directions in the plane of the connector cover;

wherein the slide plate includes a receiving portion in which the resilient pawls are inserted and engaged;

wherein the resilient pawls absorb deviations in the front-rear and left-right directions occurring at the time of connecting the female and the male connectors; and wherein the plurality of resilient pawls are formed such that proximal ends of each of the plurality of resilient pawls are connected to an inner side of a frame body, where the frame body is formed so as to stand upright from a center portion of an upper surface of the connector cover and each of the plurality of resilient pawls is extended parallel to the frame body from a junction with respect to the frame body, and has a bulbous portion at the distal end thereof.

13. A self-aligning connector comprising:

a female connector which is adapted to include a plurality of electrical components which is secured to one securing portion;

a male connector connectable to the female connector, the male connector being adapted to include a plurality of electrical components which is secured to another securing portion; and a connector cover and a slide plate, which are disposed between the one securing portion and the another securing portion;

wherein the connector cover includes a plurality of resilient pawls, which has distal ends located in the vicinity of a center portion of the connector cover in front-rear and left-right directions in the plane of the connector cover;

wherein the slide plate includes a receiving portion in which the resilient pawls are inserted and engaged;

wherein the resilient pawls absorb deviations in the front-rear and left-right directions occurring at the time of connecting the female and the male connectors; and wherein the slide plate has a U-shaped opening formed at an upper surface side of the side plate so that the extended piece is centrally-located and formed, where the plurality of resilient pawls are set within the opening such that the distal ends thereof touch the three side surfaces of the extended piece.

14. A self-aligning connector comprising:

a female connector which is adapted to include a plurality of electrical components which is secured to one securing portion;

a male connector connectable to the female connector, the male connector being adapted to include a plurality of electrical components which is secured to another securing portion; and a connector cover and a slide plate, which are disposed between the one securing portion and the another securing portion;

wherein the connector cover includes a plurality of resilient pawls, which has distal ends located in the vicinity of a center portion of the connector cover in front-rear and left-right directions in the plane of the connector cover;

wherein the slide plate includes a receiving portion in which the resilient pawls are inserted and engaged;

wherein the resilient pawls absorb deviations in the front-rear and left-right directions occurring at the time of connecting the female and the male connectors; and wherein each of the plurality of resilient pawls has an amount of elastic deformation which is settable by way of a clearance between a frame body of the connector cover and each of the plurality of resilient pawls.

15. A self-aligning connector comprising:

a female connector which is adapted to include at least one electrical component;

a male connector connectable to the female connector, the male connector being adapted to include at least one electrical component; and at least one connector cover and at least one slide plate;

wherein the connector cover includes a plurality of resilient pawls, which has distal ends located in the vicinity of a connector cover center portion in front-rear and left-right directions in the plane of the connector cover;

wherein the slide plate includes a receiving portion in which at least two of the plurality of resilient pawls are inserted and engaged;

wherein the plurality of resilient pawls align the female and the male connectors, wherein the receiving portion includes an opening and a slot; and wherein the connector cover includes a frame body located at a substantial center of the connector cover, and the frame body is formed with three resilient pawls, which are inserted and engaged in the opening of the slide plate.

* * * * *